US006209876B1

(12) United States Patent
Franklin

(10) Patent No.: US 6,209,876 B1
(45) Date of Patent: Apr. 3, 2001

(54) FOOTBALL TARGET GAME

(76) Inventor: Kevin Franklin, 3213 W. Freeport, Broken Arrow, OK (US) 74012

( * ) Notice: Subject to any disclaimer, the term of this patent is extended or adjusted under 35 U.S.C. 154(b) by 0 days.

(21) Appl. No.: 09/206,861

(22) Filed: Dec. 8, 1998

Related U.S. Application Data

(60) Provisional application No. 60/069,076, filed on Dec. 9, 1997.

(51) Int. Cl.[7] ..... A63F 7/20

(52) U.S. Cl. ..... 273/317.5; 273/108.1

(58) Field of Search ..... 473/470, 416, 473/458; 273/317.5, 108.4, 108.1; 2/170

(56) References Cited

U.S. PATENT DOCUMENTS

| | | | | |
|---|---|---|---|---|
| 2,140,193 | * | 12/1938 | Weinberger | 273/317.5 |
| 2,247,852 | | 7/1941 | Saunders | 273/105 |
| 3,169,019 | * | 2/1965 | Genjack | 473/457 |
| 3,328,033 | | 6/1967 | Hendry | 273/182 |
| 3,373,445 | * | 3/1968 | O'Neill | 2/170 |
| 3,643,950 | | 2/1972 | Holk | 273/105 |
| 3,726,525 | * | 4/1973 | Jackson | 473/61 |
| 4,061,256 | * | 12/1977 | Beer et al. | 224/219 |
| 4,068,846 | * | 1/1978 | Forrest | 473/439 |
| 4,550,911 | * | 11/1985 | Daley | 273/317.5 |
| 4,643,433 | | 2/1987 | Wehby | 273/402 |
| 4,826,166 | | 5/1989 | Baker et al. | 273/55 |
| 4,927,145 | | 5/1990 | Davis | 273/94 |
| 5,029,853 | | 7/1991 | Cunningham | 273/29 |
| 5,037,095 | | 8/1991 | Nedwick | 273/55 |
| 5,309,328 | * | 5/1994 | Lum | 361/809 |
| 5,333,865 | | 8/1994 | Holmes | 273/94 |
| 5,516,115 | * | 5/1996 | McClain | 473/417 |
| 5,524,901 | | 6/1996 | Bison et al. | 273/400 |
| 5,558,338 | | 9/1996 | Taub | 273/411 |
| 5,570,879 | * | 11/1996 | Glacey et al. | 473/472 |
| 5,570,888 | | 11/1996 | Robinson et al. | 273/317 |

* cited by examiner

*Primary Examiner*—Jeanette Chapman
*Assistant Examiner*—M. Chambers
(74) *Attorney, Agent, or Firm*—Head, Johnson & Kachigian

(57) ABSTRACT

A football target game for one or more players. The game includes a surrounding target having a goal post extending from a base, a crossbar perpendicular to the goal post, and a pair of uprights extending upward from the crossbar. A center target within the surrounding target includes a top rail extending between the pair of uprights and a U-frame member extending from the top rail. The targets are supported by either a base or a door hanger suspended from a door. The surrounding target has a net connected to the crossbar, the uprights and top rail while the center target has a net connected to the top rail and the U-frame members, the nets being of different colors. A plurality of footballs are provided, each football to be flicked toward the targets by a player's finger, each football to be initially held on a tee. A handheld tee may be used to support the tee on a player's hand.

4 Claims, 6 Drawing Sheets

Fig. 6
N the ZONE FOAM FOOTBALL
SCORECARD
| Player | 1st QTR | 2nd QTR | 3rd QTR | 4th QTR | TOTAL |
|---|---|---|---|---|---|
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
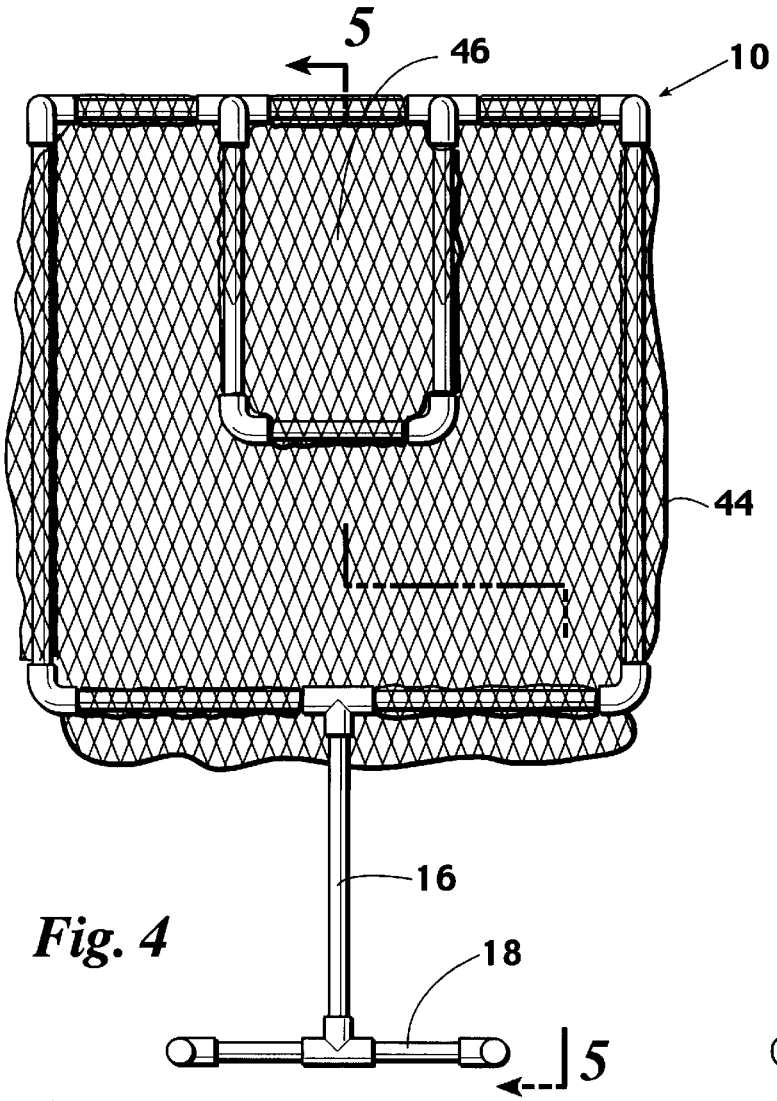
Fig. 4
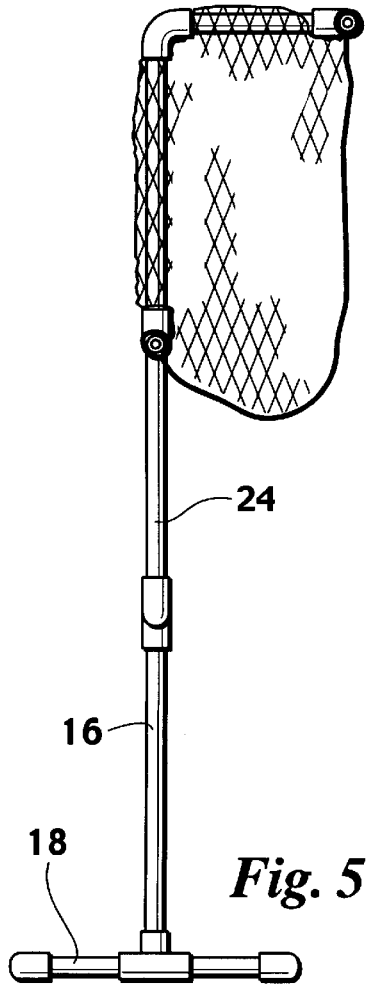
Fig. 5

FOOTBALL TARGET GAME

CROSS REFERENCE TO RELATED APPLICATION

This application is based on Provisional Application No. 60/069,076 entitled FOOTBALL TARGET GAME, filed Dec. 9, 1997.

BACKGROUND OF THE INVENTION

1. Field of the Invention

The present invention is directed to a football target game having a surrounding target and a center target which simulate the look of a football goal post. In particular, the present invention is directed to a football target game that may be set up and played indoors to provide a game of amusement in a relatively restricted place.

2. Prior Art

The game of football, while extremely popular, can normally not be played inside because of the 100 yard field and the football used. Various derivatives of a tabletop simulated football game have been known. By way of example, U.S. Pat. No. 5,570,888, Robinson et al., provides a thumb football game and apparatus which pertains to a table top football game in which a simulated football is thumped by the finger of a player on a table top simulated football field. Countless variations of this type of game are known.

Holmes (U.S. Pat. No. 5,323,865) provides an amusement game with a simulated playing field and a toy football made of soft material.

In a regular football game, a one hundred yard field is used marked in 5 yard increments. Three points are awarded for a football kicked through the uprights and 1 point is awarded for a football kicked through the uprights after a touchdown.

Nevertheless, there remains a need for a game which may be played in a restricted space and simulates football field goal and extra point kicking.

It is, therefore, a principle object and purpose of the present invention to provide a football target game to be used to simulate field goal and extra point field goal kicking.

It is a further object and purpose of the present invention to provide a football target game having a surrounding target including a goal post, a crossbar perpendicular to the goal post, and a pair of uprights extending from the crossbar, a center target within the surrounding target including a top rail extending between the pair of uprights and a U-frame extending from the top rail; a plurality of footballs to be flicked toward the target; and a tee for holding one of the footballs.

It is a further object and purpose of the present invention to provide a football target game having a net for the surrounding target connected to the crossbar, the uprights, and the top rail and a net for the center target connected to the top rail and the U-frame members, the nets being of different colors.

It is a further object and purpose of the present invention to provide a football target game including a pair of dice to select a horizontal distance and a position for the football spaced from the targets.

It is a further object and purpose of the present invention to provide a football target game having a door hanger to suspend the target from the door, and thereby saving floor space in a room where the football target game is used.

It is a further object and purpose of the present invention to provide a football target game having a wristband to support the tee on players' arms.

It is a further object and purpose of the present invention to provide a method to play a football target game including: rolling a pair of dice by a first player, one of the dice indicating a horizontal distance from a target area and another of the dice indicating a position with respect to the target area; placing a football a horizontal distance spaced from the target and in a position as indicated by the dice; flicking a football towards the target area; scoring points for each football in a center target and a surrounding target in the target area; flicking each football and scoring points for each of a plurality of footballs; and repeating the process for each player.

It is a further object and purpose of the present invention to provide a method to play a football target game including retaining footballs received in the surrounding target with a surrounding net and retaining footballs received in the center target with a center net.

SUMMARY OF THE INVENTION

The present invention is directed to a football target game. A target structure includes a surrounding target. The surrounding target includes a upstanding goal post which extends from a base to support the goal post. The surrounding target also includes a crossbar extending from and perpendicular to the goal post. A pair of uprights extends upward from the crossbar. The goal post, the crossbar and the uprights together form a simulated goal post.

A center target lies within the surrounding target. The center target includes a top rail spaced back from and out of alignment with the uprights, the crossbar and the goal post. The top rail is spaced from the uprights by a pair of rail spacers. Extending outward from the top rail is a pair of center target spacers which connect with three U-shaped members. The three U-shaped members form the periphery of the center target.

A net for the surrounding target is connected to the crossbar, the pair of uprights, and the top rail. A net for the center target is connected to the top rail, the center target spacers, and the U-shaped members. The surrounding target net differs in color from the center target net. The nets are each loosely arranged on the surrounding target and the center target so that each forms a receptacle for receipt of a football received in it.

In order to play the game, one player will initially roll both dice. One of the dice will have yard line indicators such as 10 yard, 20 yard, 30 yard, 40 yard and 50 yard. The other dice of the pair will indicate the has mark or horizontal position from which the footballs will be shot toward the target structure.

Once the yard line and position is indicated by the throw of the dice, all of the game balls will be shot or flicked and directed toward the target. If six footballs are utilized, each one will be sequentially flicked with a finger of the player toward the target areas of the target structure. Three points are awarded for a football which goes into the center target while a single point is awarded for a football in the surrounding area. The score is then entered for that player and recorded on the score card. The game will continue with the next player repeating the same process. The second and subsequent players will shoot from the same location.

The same procedure may be repeated four times to simulate four quarters of a regular football game. The player with the most points is declared the winner.

BRIEF DESCRIPTION OF THE DRAWINGS

FIG. 4 is a front view of the target structure with nets attached;

FIG. 5 is a sectional view taken along section 5—5 of FIG. 4;

FIG. 6 is an example of a scorecard to be used as a part of the football target game of the present invention;

DETAILED DESCRIPTION OF THE PREFERRED EMBODIMENTS

Figure 3:
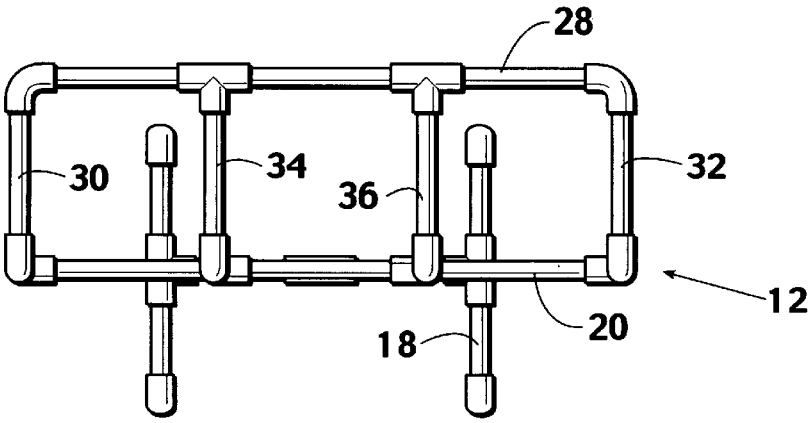
FIG. 3 is a top view of the football target structure shown in FIG. 1.
Figure 1:
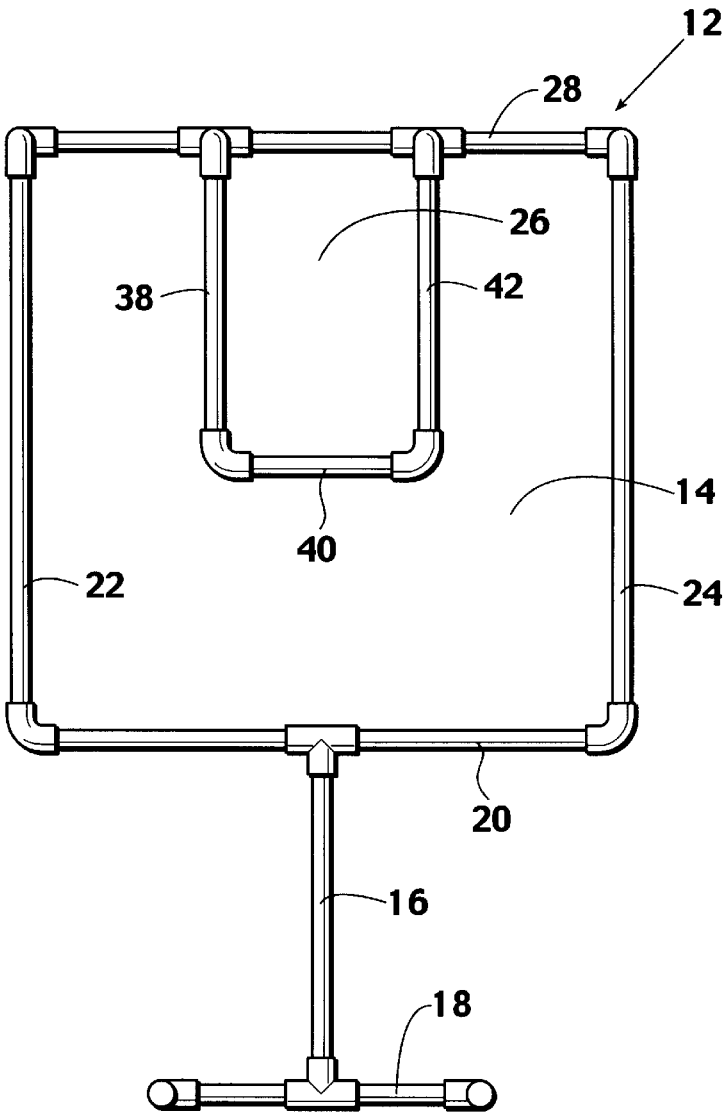
FIG. 1 is a front view of a target structure for a football target game constructed in accordance with the present invention.
Figure 2:
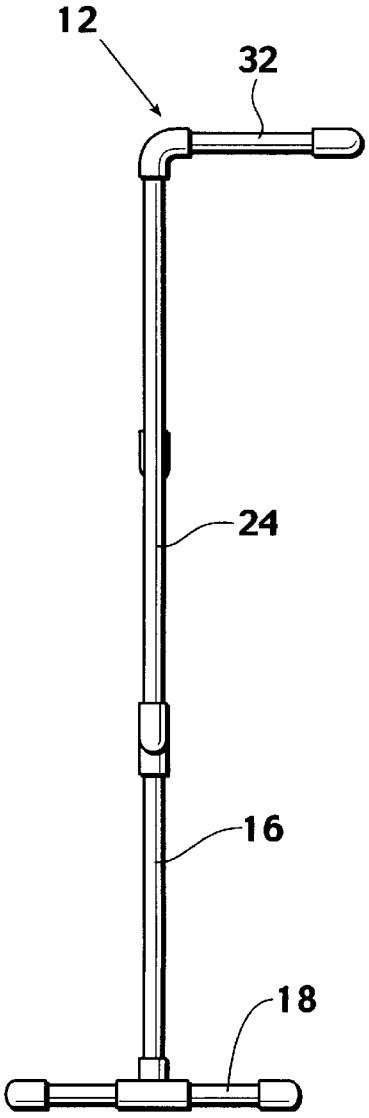
FIG. 2 is a side view of the football target structure shown in FIG. 1.

Referring to the drawings in detail, FIGS. 1 through 4 illustrate a target structure 12 for a football target game constructed in accordance with the present invention. The target structure 12 is shown in FIGS. 1, 2 and 3 with the nets (to be described in detail) removed for clarity.

With reference to FIGS. 1, 2 and 3, the target structure 12 includes a surrounding target 14. The surrounding target 14 includes an upstanding goal post 16 which extends from a base 18, having a cross member 17 and feet 19, to support the goal post 16, on a surface such as a floor (not shown).

The surrounding target 14 also includes a crossbar 20 extending from and perpendicular to the goal post 16. The crossbar 20 is thus parallel to the base cross member 17. A pair of uprights 22 and 24 extends upward from the crossbar. The goal post 16, the crossbar 20, and the uprights 22 and 24 are all in a substantially co-planar assignment as shown in FIG. 2. The goal post 16, the crossbar 20, and the uprights 22 and 24 together form a simulated football goal post.

A center target 26 lies within the surrounding target 14. The center target 26 includes a top rail 28. The top rail 28 is spaced back from and out of alignment with the uprights 22 and 24, the crossbar 20 and the goal post 16. This arrangement can be best seen in FIGS. 2 and 3. The top rail 28 is spaced from the uprights 22 and 24 by a pair of rail spacers 30 and 32. Extending from the top rail 28 is a pair of center target spacers 34 and 36 which connect with U-shaped members 38, 40 and 42. The U-shaped members 38, 40 and 42 form a periphery of the center target 26.

In the present embodiment, the target structure 12 is constructed of lightweight plastic, such as polyvinyl chloride (PVC). PVC tubes used in target structure 12 are attached together by elbows or connectors. It will be understood that the target structure 12 may be fabricated from other materials within the teachings of the invention.

With reference to FIG. 4, a net 44 for the surrounding target 14 is connected to the crossbar 20, the pair of uprights 22 and 24 and the top rail 28. A net 46 for the center target 26 is connected to the top rail 28, the center target spacers 34 and 36, and the U-shaped members 38, 40 and 42. In one embodiment, the surrounding target net 44 is a white color while the center target net 46 is a red color. The nets 44 and 46 are loosely arranged on both the surrounding target 14 and the center target 26 so that each of the nets 44 and 46 forms a receptacle for receipt of a football 56 directed toward it.

FIGS. 6, 7, 8, 9, 10 and 11 illustrate the various elements of the football target game. FIG. 6 illustrates a prototypical scorecard wherein a plurality of players will keep score of their various points obtained by "kicking" footballs in the target areas. Each player is listed in the left hand column while the score is recorded for each quarter.

Figure 7:
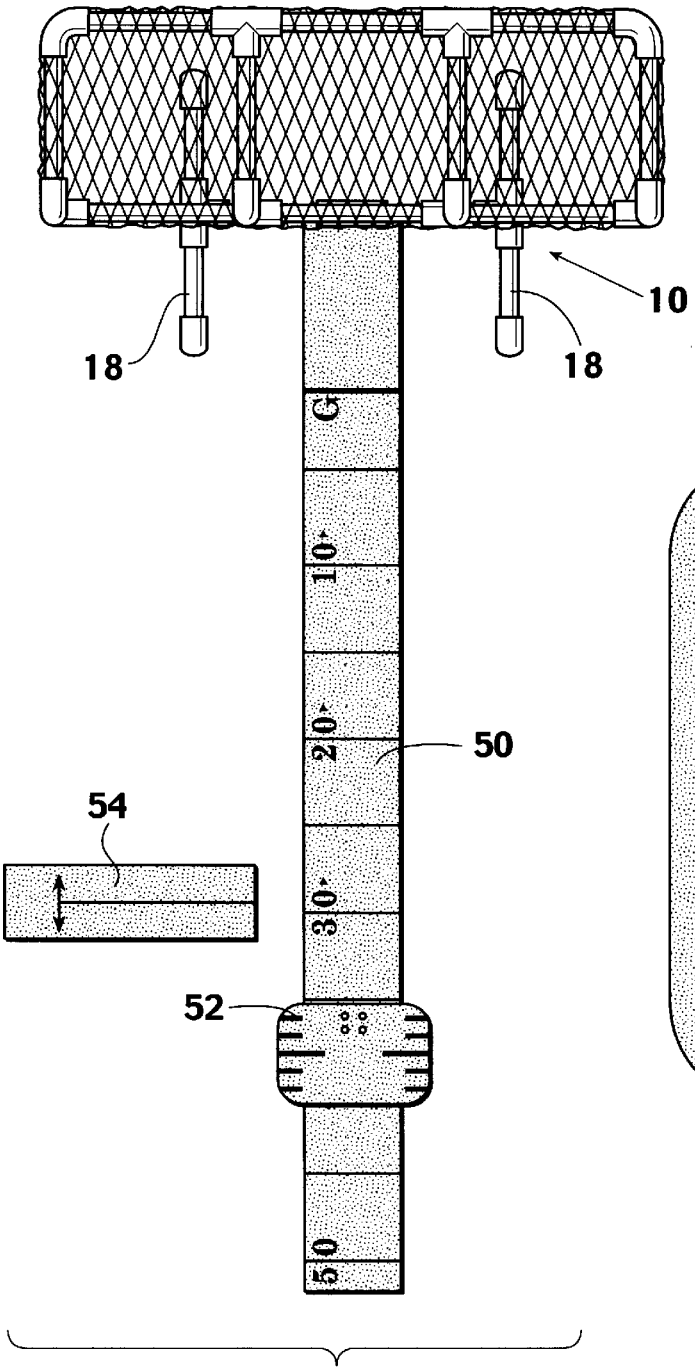
FIG. 7 is a top view of the football target game including a cloth or tape for yard line markers and a tee.
Figure 9:
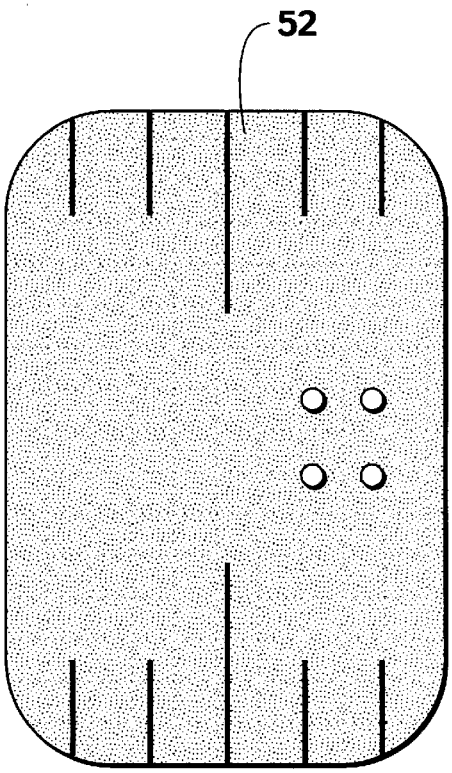
FIG. 9 is a top view of a tee used as a part of the football target game.

FIG. 7 is a top view of the structure 12 with a tape or cloth yard indicator 50 extended from the structure. A tee 52 (also shown in FIGS. 8 and 9) is used to position the football 56 prior to the shot. Position indicator 54 is also provided to establish the positions for right and left hash marks. The yard indicator 50 is shown in perspective in FIG. 11.

Figure 8:
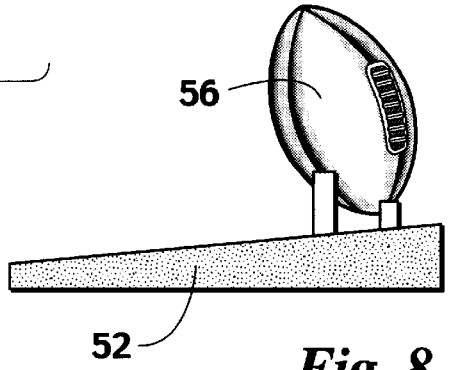
FIG. 8 is a side view of the tee with a football thereon used in connection with the football target game of the present invention.
Figures 10, 11, 12:
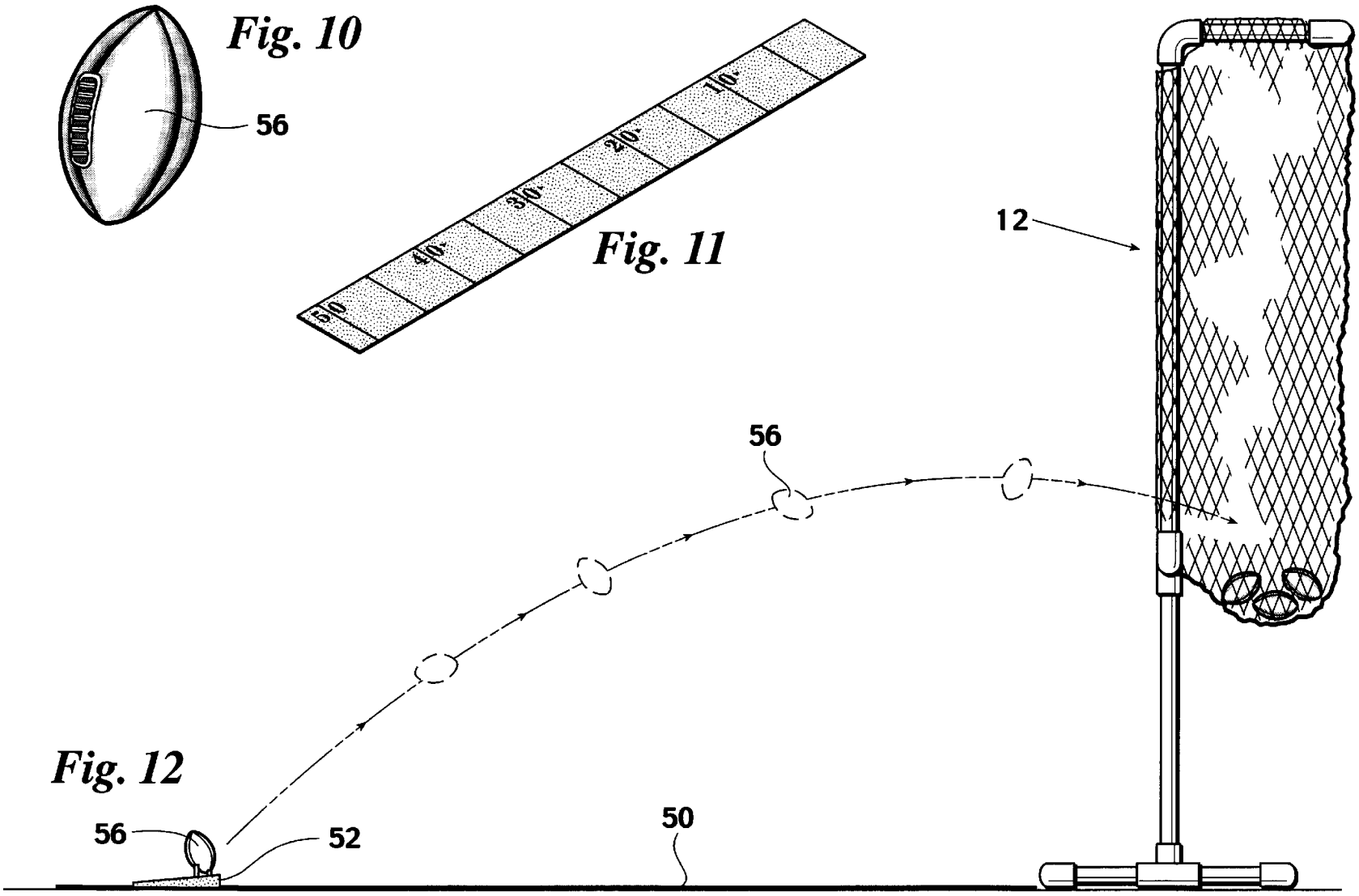
FIG. 10 is an example of a football which is a part of the football target game.
FIG. 11 shows a cloth or tape used as a yard indicator with the present invention.
FIG. 12 shows a side view illustrating a shot of one of the footballs from the tee into the surrounding target with the trajectory of the football shown in dashed lines.

In FIG. 8, a football 56 is shown mounted on the tee 52. In the present embodiment, a foam football is utilized although other types such as a hollow plastic football might be employed. In FIG. 10, a football 56 is shown without a tee.

In FIG. 12, a football 56 is shown mounted on the tee 52. The dashed trajectory line indicates a typical trajectory which a football 56 may take in traveling from tee 52 to net 46. Three footballs 56 have already been flicked through the surrounding target 14 and have formed a pile in the bottom of net 46.

Figure 13:
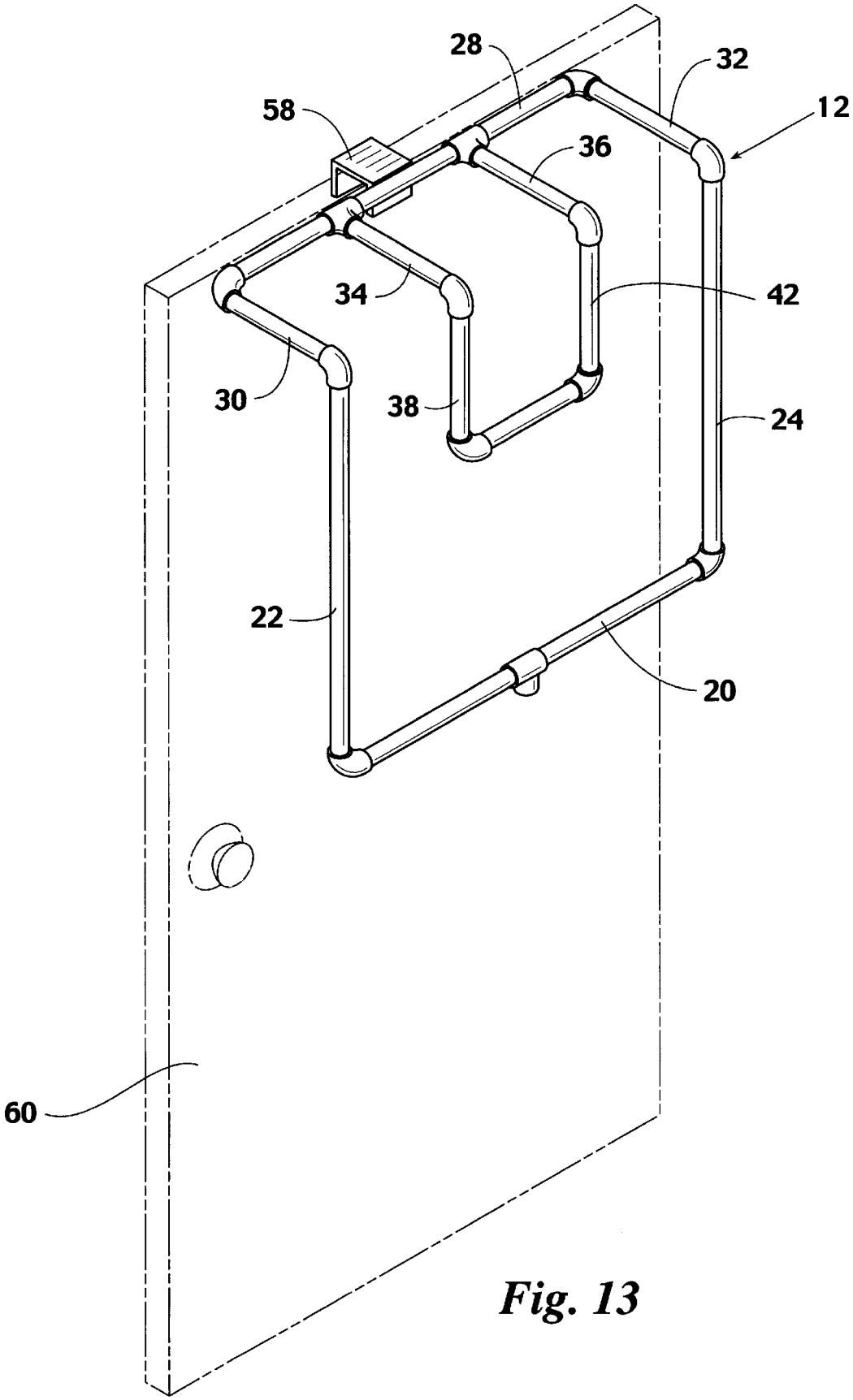
FIG. 13 shows a perspective view of a football target game of the present invention suspended from a door hanger.

In an alternative embodiment shown in FIG. 13, the top rail 28 is balanced on a front hook portion 62 of door hanger 58. Door hanger 58 rests on top of door 60. In this embodiment, there is no need for a base 18 or a goal post 16, because the crossbar 20 and the uprights 22 and 24 are supported by the door hanger 58.

Figure 14:
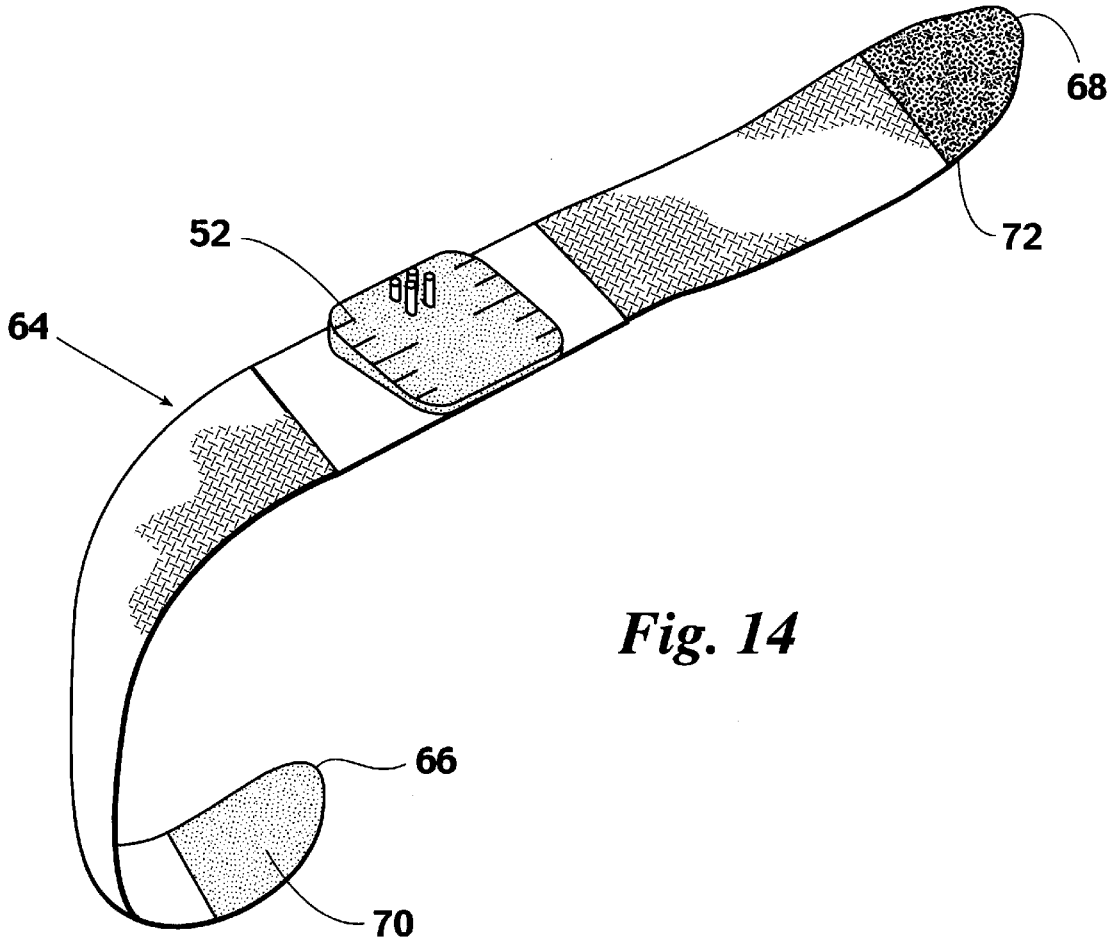
FIG. 14 shows a perspective view of a handheld tee used to support a tee on a player's arm.

In another embodiment shown in FIG. 14, tee 52 is attached to wristband 64. The wristband 64 has a first end 66 and a second end 68. A loop portion 70 of a hook-and-loop type fastener, such as Velcro, is located at the first end 66. A hook portion 72 of the hook-and-loop type fastener is located at the second end 68. A player fastens the handheld tee 64 by pressing the loop portion 70 against hook portion 72. With the tee 52 resting on a player's hand, that player may position a finger to flick the football 56 more directly underneath the football 56.

Figure 15:
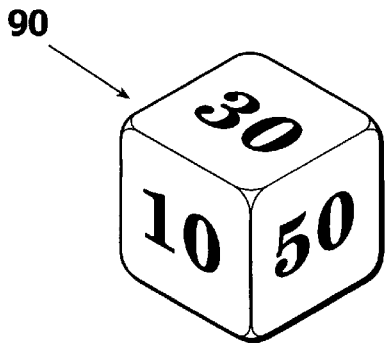
FIG. 15 shows a perspective view of a bash mark dice of the present invention.
Figure 16:
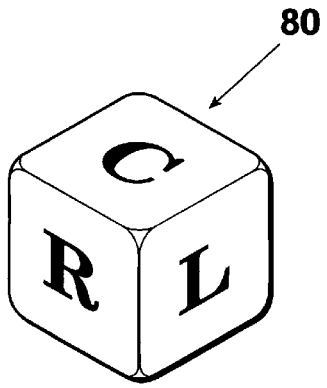
FIG. 16 shows a perspective view of a yard indicator dice of the present invention.

A pair of dice, shown in FIGS. 15 and 16, is used in one present embodiment of the game. It will be understood that other determiners such as a spinning dial might alternately be used to achieve the same results. In the present embodiment of the game which uses two dice, one player begins the game by rolling a hash mark dice 80 and a yard indicator dice 90. The yard indicator dice 90 has yard line indicators: ten yards, twenty yards, thirty yards, forty yards, fifty yards, and sixty yards. The hash mark dice 80 indicates a hash mark or horizontal position from which the footballs 56 will be shot toward the target structure 12.

For the yard indicator dice 90 shown in FIG. 15, the numbers on opposite faces of the yard indicator dice 90 add to seventy yards. For the hash mark dice shown in FIG. 16, markings on faces of a hash mark dice 80 indicate the hash marks, such that two opposing faces indicate the right hash mark (R), two opposing faces indicate the left hash mark (L) and two opposing faces indicate the center hash mark (C).

Once the yard line and hash mark position is indicates, the first player sets the tee 52 on the appropriate yard line and the indicated hash mark. The first football 56 is placed on the tee 52 as shown in FIG. 7 and the player uses his or her index or middle finger to flick the football 56.

All of the footballs 56 are flicked from tee 52 toward the target structure 12. Three points will be awarded for a football 56 which goes into the center target 26 while a single point will be awarded for a football in the surrounding target 14. The score will then be entered and recorded on a score card.

The game will continue with the next player in the same fashion. The next player will shoot each of his footballs 56 from the first player's location. When all the players have completed their turn, the score will be entered for the first quarter.

To begin the second quarter, the second player will roll the dice. The same procedure may be repeated four times to simulate four quarters of a regular football game. At the end, the player with the most points is declared the winner. In the event of a tie, an extra quarter is played.

The target structure 12 is lightweight and the target structure 12, the cloth tape and position indicator, as well as the tee 52 and football 56 can be easily moved.

Whereas, the present invention has been described in relation to the drawings attached hereto, it should be understood that other and further modifications, apart from those shown or suggested herein, may be made within the spirit and scope of this invention.

What is claimed is:

1. A simulated football game for one or more players comprising:

(a) a football goal target structure for use in a simulated football game;

(b) a wristband to be placed on a wrist of a player, said wristband having a tee extending from said wristband; and (c) a miniature football placeable on said tee and struck by a finger from the hand from an opposite arm of said player.

2. The simulated football game of claim 1 wherein said target structure further comprises a surrounding target and a center target within said surrounding target.

3. The simulated football game of claim 2 wherein said surrounding target comprises:

(a) a crossbar substantially horizontal to a ground level; and (b) a pair of uprights substantially perpendicular to said crossbar and extending upwards from said crossbar.

4. The simulated football game of claim 3 wherein said center target comprises:

(a) a top rail extending between said uprights; and (b) a U-frame member extending from said top rail.

* * * * *